US008365481B2

(12) United States Patent
Scully et al.

(10) Patent No.: US 8,365,481 B2
(45) Date of Patent: Feb. 5, 2013

(54) ANCHORAGE SYSTEM OF VENTILATED FACADES

(76) Inventors: Joe Scully, Dublin (IE); Tom Scully, Dublin (IE); Sean Daly, Dublin (IE)

( * ) Notice: Subject to any disclaimer, the term of this patent is extended or adjusted under 35 U.S.C. 154(b) by 0 days.

(21) Appl. No.: 12/747,750

(22) PCT Filed: Dec. 12, 2008

(86) PCT No.: PCT/EP2008/010615

§ 371 (c)(1),
(2), (4) Date: Sep. 13, 2010

(87) PCT Pub. No.: WO2009/074346

PCT Pub. Date: Jun. 18, 2009

(65) Prior Publication Data

US 2010/0325997 A1 Dec. 30, 2010

(30) Foreign Application Priority Data

Dec. 13, 2007 (ES) ..... 200703294

(51) Int. Cl.
*E04H 1/00* (2006.01)
*E04B 2/30* (2006.01)
*E04B 1/38* (2006.01)

(52) U.S. Cl. ..... 52/235; 52/489.1; 52/243; 52/236.7; 52/512

(58) Field of Classification Search ..... 52/235, 52/489.1, 474, 243, 236.7, 236.9, 281, 285.3, 52/489.2, 511, 513
See application file for complete search history.

(56) References Cited

U.S. PATENT DOCUMENTS

| | | | | |
|---|---|---|---|---|
| 3,561,182 | A * | 2/1971 | Madl, Jr. | 52/479 |
| 5,301,484 | A * | 4/1994 | Jansson | 52/235 |
| 5,544,461 | A * | 8/1996 | Sommerstein | 52/235 |
| 6,098,364 | A * | 8/2000 | Liu | 52/506.08 |
| 6,226,947 | B1 * | 5/2001 | Bado et al. | 52/483.1 |
| 6,289,644 | B1 * | 9/2001 | Gerhaher | 52/235 |
| 6,425,218 | B1 * | 7/2002 | Doyon et al. | 52/235 |
| 6,502,362 | B1 * | 1/2003 | Zambelli et al. | 52/698 |
| 7,043,884 | B2 * | 5/2006 | Moreno | 52/235 |
| 7,726,083 | B2 * | 6/2010 | Wagner | 52/235 |
| 2003/0150179 | A1 * | 8/2003 | Moreno | 52/235 |
| 2004/0079038 | A1 * | 4/2004 | Crooker, Jr. | 52/235 |
| 2008/0010922 | A1 * | 1/2008 | Wagner | 52/235 |
| 2008/0155917 | A1 * | 7/2008 | Bilge | 52/235 |
| 2008/0310913 | A1 * | 12/2008 | Urban et al. | 403/404 |
| 2010/0132293 | A1 * | 6/2010 | Voegele et al. | 52/402 |
| 2010/0154336 | A1 * | 6/2010 | Wagner | 52/235 |

FOREIGN PATENT DOCUMENTS

| | | |
|---|---|---|
| CH | 659 679 | 2/1987 |
| ES | 2 156 525 | 6/2001 |
| ES | 1 064 372 | 3/2007 |
| FR | 2 517 800 | 6/1983 |
| GB | 2 108 173 | 5/1983 |

* cited by examiner

*Primary Examiner* — Mark Wendell
(74) *Attorney, Agent, or Firm* — Charles T. Riggs, Jr.

(57) ABSTRACT

It comprises a series of vertical profiles (1, 20, 21) anchored to cogged brackets (3) and previously fixed to the slabs or resistant structure of the building. It also comprises horizontal profiles (15) which are fastened to said vertical profiles and to which retention clamps (27, 28, 29, 32, 33) are connected in the flagstones (24), which have grooves on their horizontal edges.

The vertical profile (1, 20, 21) has a frontal "C" rail (18) which is fixed to one of the U-shaped parts (16) that interconnect with other parts (17) mounted on a C-rail (19) of the horizontal profile (15).

The horizontal profile (15) includes frontal upwards flanges (25, 26) for anchoring clamps (27, 28, 29, 32, 33) with flanges (31) to be inserted in the grooving of the flagstones (24).

17 Claims, 13 Drawing Sheets

A-A'

ANCHORAGE SYSTEM OF VENTILATED FACADES

This application is a National Stage Application of PCT/EP2008/010615, filed 12 Dec. 2008, which claims benefit of Serial No. P200703294, filed 13 Dec. 2007 in Spain and which applications are incorporated herein by reference. To the extent appropriate, a claim of priority is made to each of the above disclosed applications.

OBJECT OF THE INVENTION

The present invention refers to an anchorage system of ventilated facades, which adds important advantages compared with similar anchorage systems and those currently used.

Once the vertical profiles are installed and attached to resistant elements of the building structure through brackets, the horizontal profiles fixed to the vertical ones are coupled using anchorage parts.

It is an aim of this invention to improve the joint between horizontal and vertical profiles, by implementing a dovetailed joint, which can also withstand thermal expansions of the structure, as well as movements/settlements of the building itself and seismic movements.

It is also an object of this invention to offer a horizontal profile which does not include a continuous flange for permanently mounting natural flagstones or alike in the horizontal groove of said flagstone, but, instead, one that has independent parts anchored to the horizontal profile in order to protect the corners of the grooved flagstone and enable an easy replacement of flagstones.

In the case of sandwich-paned insulating panel mounting, it is also planned that the fastening of these panels be carried out without drilling the panel, thus, avoiding the formation of an entrance of air and/or water into the building.

Another advantageous characteristic of the horizontal profile is that since it does not have an upper wing for common and continuous use, it can be adapted to any facade element (wood, metal panels, ceramic, etc.) simply by mounting appropriate fastening clips.

BACKGROUND OF THE INVENTION

Nowadays, there exist different anchorage systems of natural or artificial stone plates to cover building facades by previously mounting vertical and horizontal profiles, as it can be seen in the ES2156525, which refers to a system for anchoring stone plates to building facades and which enables mounting stone plates outside the sequence and in different elevations, as well as replacing any stone plate without breaking the structure. The articulated tubular framing is coupled to the building structure by mounting, first, masts or vertical profiles that will fasten the horizontal ones. The masts have an asymmetric section and two of its consecutive sides have cogged rubber, also being these cogged sides fitted with recesses that define guiderails for inserting bolts. The horizontal profiles are located in all the horizontal joints of the stone plates to be laid, having these joints corresponding longitudinal grooves at the upper and lower edges.

The horizontal profile has spear-headed flaps to anchor and hold fastening elements or clips, having also an L-shaped wing that fits into the groove of the stone plates.

In the utility model 200602658, it was claimed an anchorage system for ventilated facades with natural or artificial stone plates, including new vertical profiles that improved the resistance of the previous profiles, comprising a geometry of a rectangular section with a C-rail in the centre of the larger sides of it, and allowing this section to be joined to the horizontal profiles and the brackets through self-tapping screws. The horizontal profile also includes an L-shaped upward flange that is inserted in the lower groove of the stone plate. In the upper groove, there are other retention flanges fixed to the horizontal upper profile through set screws.

The retention flanges with a connecting screw between the slate and the horizontal profiles are made of extruded aluminum and they join the upper part of the stone plates, thus, being said stone plates held by two retention flanges with screw, which are fixed to the horizontal profile by self-tapping screws. These retention flanges with screw allow for a fast mounting, and they efficiently provide resistance once they are fixed in the horizontal profile due to its paracentral tab, which is inserted in the respective longitudinal upper channel of the horizontal profile and later fixed with screws.

DESCRIPTION OF THE INVENTION

In general terms, even though the anchorage system of ventilated facades, object of this invention, belongs to the same kind of systems of the above mentioned patents and utility model, it includes important improvements in the structure to attain the characteristics that constitute the object of this invention.

The fixing elements or brackets join the vertical profiles to the building structure, having the vertical profile section trapezoidal grooves or lateral rails, into which sliding bars with the same shape as the profiles are vertically inserted, and which bars are provided with a central threaded hole for fixing a bolt through the corresponding bracket, being the fixing completed with serrated lockwashers to facilitate the plumbing. The brackets also have a clogged surface and a horizontal groove which allows for the insertion of the set screw. The vertical bar that slides along the rail of the vertical profile protrudes from both ends with respect to the bracket and is anchored to the profile with end screws.

There exist two types of vertical profiles of different section which are coupled to the brackets in the same way, and there also exist a third vertical profile with break of thermal bridge, which is a compound profile consisting of the two aforementioned vertical profiles, joined together by parallel plastic partitions.

When this compound vertical profile is used, it is formed a means of settling the insulating panels, which are held by "omega" clips fixed to the front of the vertical profile by one of their wings.

The horizontal profiles are attached to the vertical ones by two complementary anchoring parts, one of which is fixed with a screw to the C-rail of the vertical profile where it is slid into to strengthen the joint; being the other complementary part slid into another C-rail in the front of the back part of the horizontal profile.

The stone plates and the horizontal profiles are joined together by a pair of clamps or retention clips for each one of the stones, being these clamps or clips interconnected by a vertical movement as they have downward flanges that interconnect with upward flanges in the front section of the horizontal profile. They also have an orthogonal wing bended upwards, downwards, or having flanges in both directions, thus being the most appropriate of them chosen, according to their position in the horizontal profiles, to fit and hold the stone plate when fitted in the continuous groove on its horizontal edges.

For mounting the flagstones, first, it is necessary to put the initial clamp, which has the upward flange where the stone is fitted by its lower groove; then, the intermediate clamp with a double upward and downward flange is placed, which functions as a retention clamp and as a support clamp for the next stone. Thus the mounting is continued, until the last course, placing the crowning clamp which has the downward flange in the upper groove.

If one of the flagstones breaks, it has also been foreseen that it can be easily replaced without breaking the structure by cutting the intermediate clamp with a radial saw at the joint between two flagstones and extracting the broken one. After this, other clamps are foreseen to hold only the lower flagstone and another clamp is fixed to support the upper one, therefor being the flagstone perfectly fixed, since these two clamps used to replace flagstones are also anchored by vertical sliding to the corresponding horizontal profile, in the same way as the rest of the clamps.

The use of single or compound vertical profiles with break of thermal bridge depends, respectively, on whether they are used for bearing walls or when the brackets can only be fixed from slab to slab.

For a better understanding of the characteristics of the invention and as a part of this descriptive memory, a series of drafts are hereto attached, with illustrative, yet non-limiting, drawings, which are clarified in the following description.

DESCRIPTION OF A PREFERRED EMBODIMENT

Figure 1:
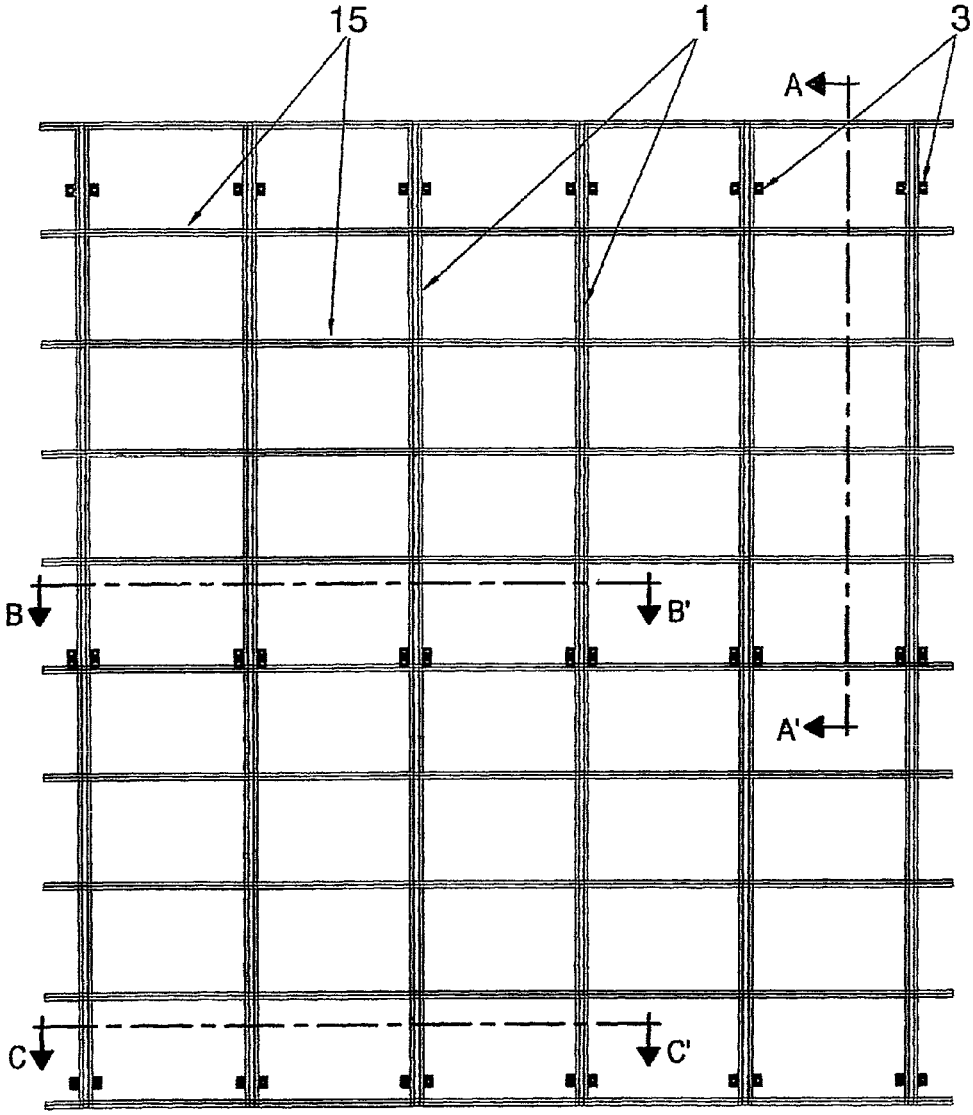
FIG. 1 shows a frontal view of a facade which includes vertical profiles fastened to fixed brackets of the resistant structure and horizontal profiles fastened to the aforementioned ones, according to the invention.
Figure 2:
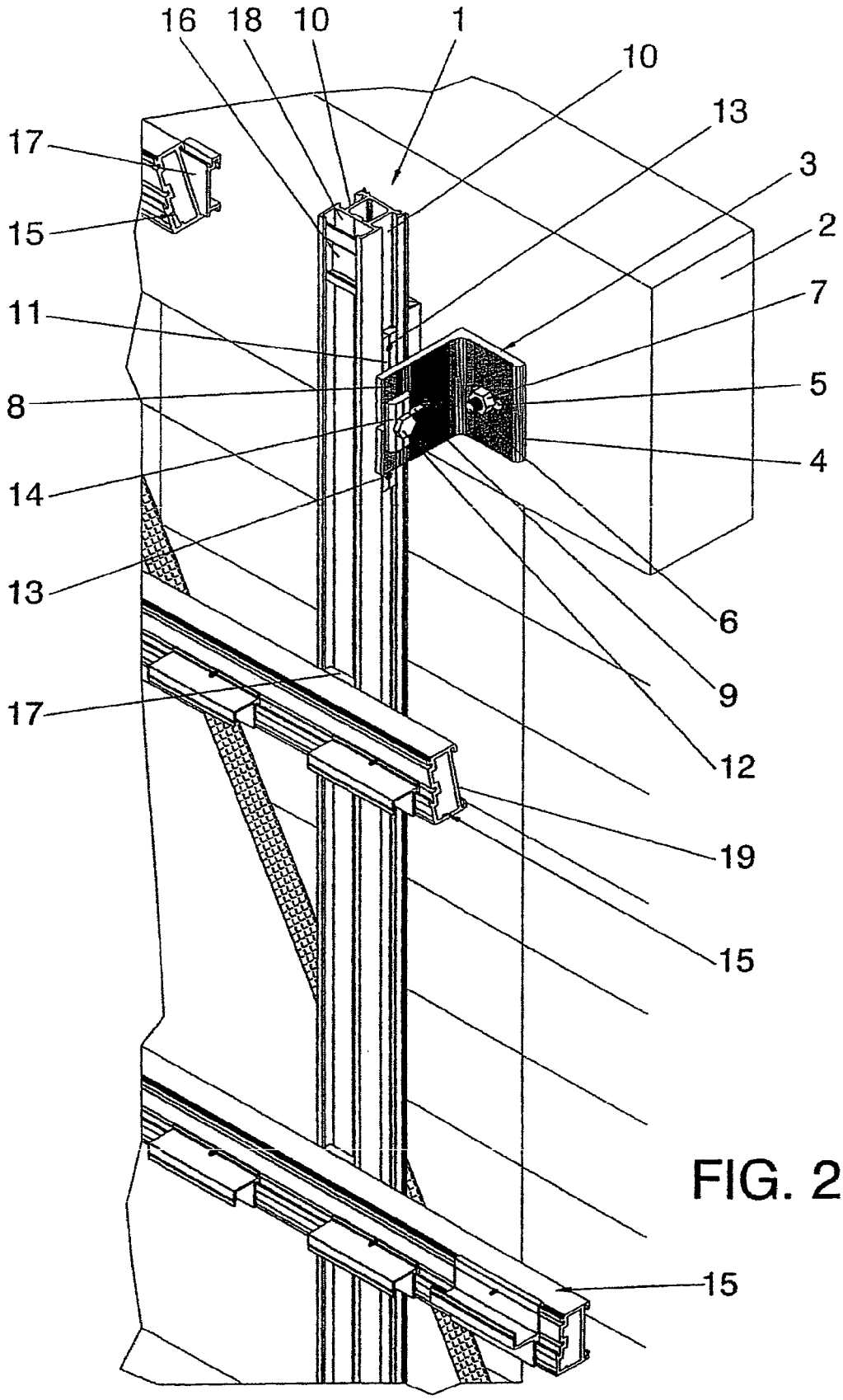
FIG. 2 shows a perspective view of the anchoring of vertical and horizontal profiles, according to the invention.
Figure 3:
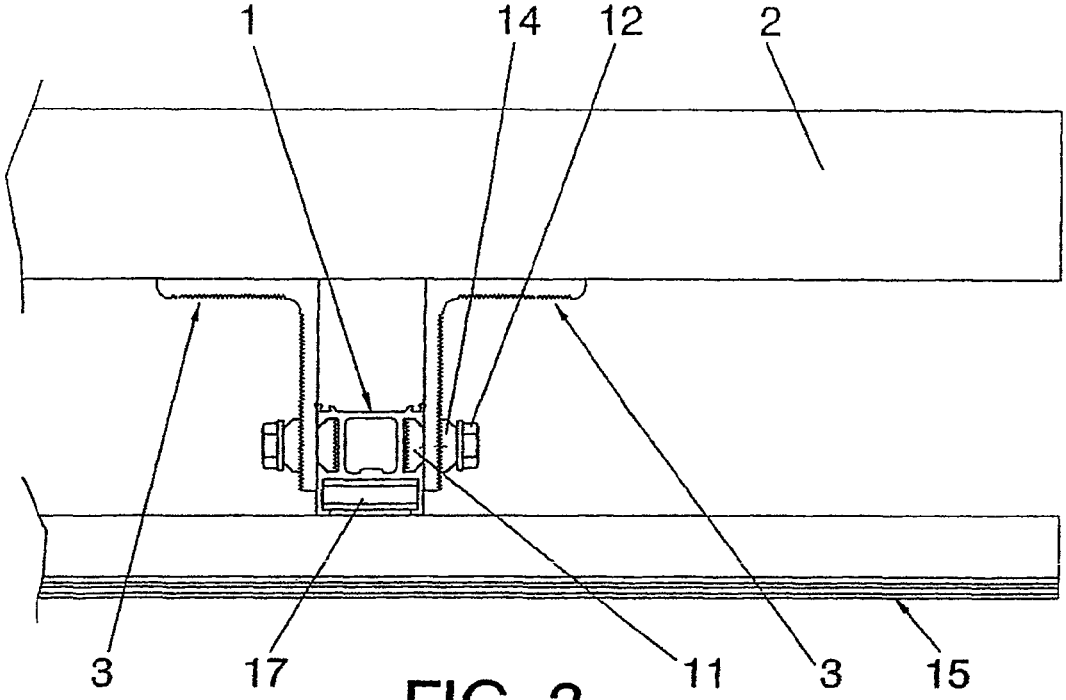
FIG. 3 shows a plan view of the illustration in FIG. 2.

With reference to the numbers in the figures, the anchorage system of ventilated facades of this invention, as shown in FIGS. 1 and 2, is defined by vertical profiles 1 fastened to the building 2 with brackets 3 on both sides.

The brackets 3 or fixing elements are L-shaped and have a wing 4 with a torn hole 5 for inserting the set screw 6, fixed with a self-locking nut 7. The free wing 8 has a longitudinal grooving 9 open at the edge for an easy mounting.

As for the vertical profile 1, it includes a C-rail 10 on its sides, into which bars 11 are slid. These bars have the same shape as the vertical profile and they are fitted with a central threaded hole and two other holes in the upper and lower ends protruding from bracket 3. The central hole serves for anchoring the set screw 12 to the bracket 3 and the end holes 13 are used to fasten the vertical profile 1 in case of a dead load. Thus, the position of these vertical sliding bars corresponds with the crosspoints with the brackets.

The screws 12 pass through an inlet ring 14 which connects with the cogged bracket 3, allowing the plumbing of the vertical profile 1. There are two types of brackets 3 with a free wing 8 of various lengths.

Figure 8:
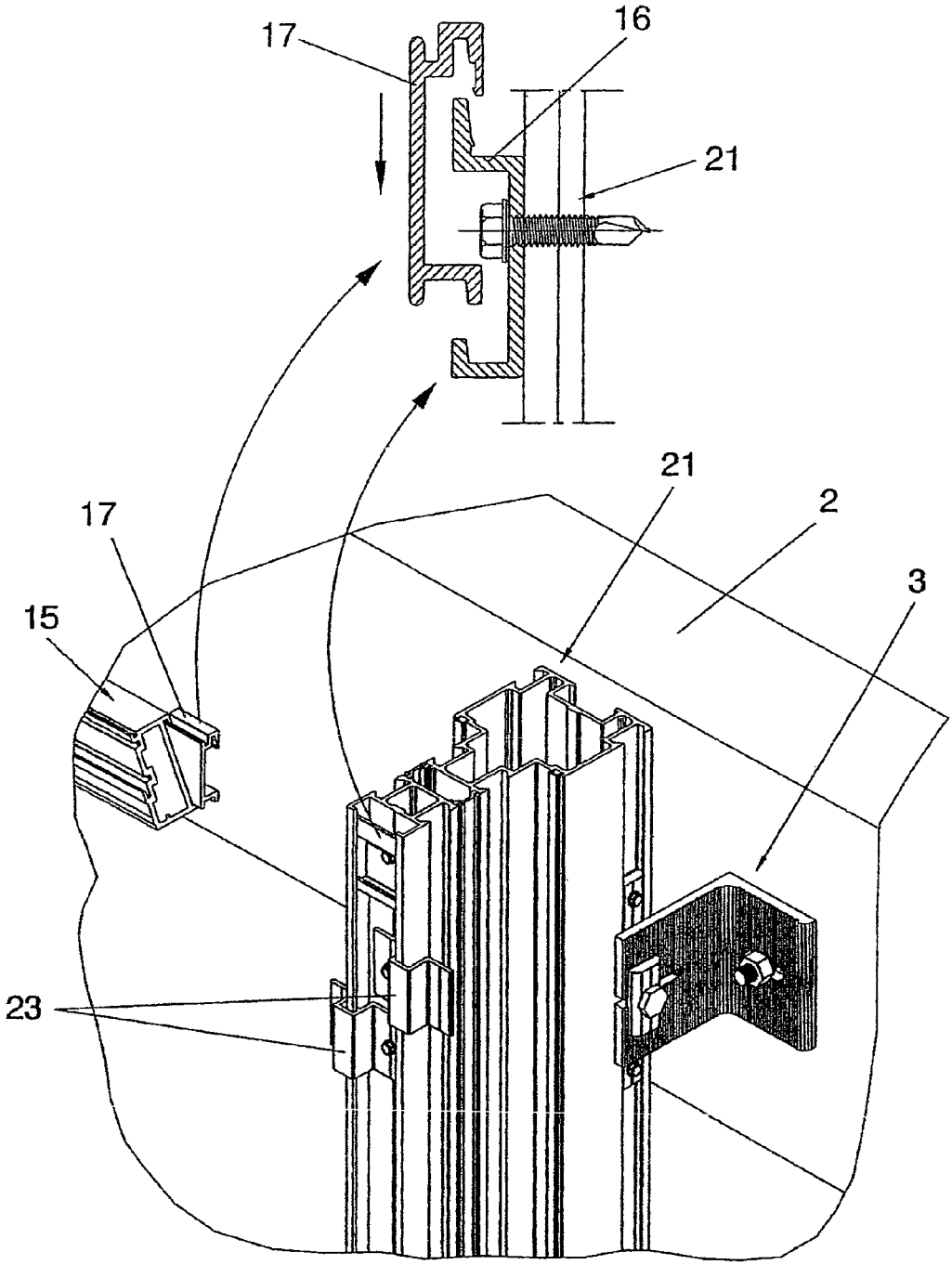
FIG. 8 shows a perspective view to see the anchoring of the horizontal profiles to the vertical ones, according to the invention.
Figure 9:
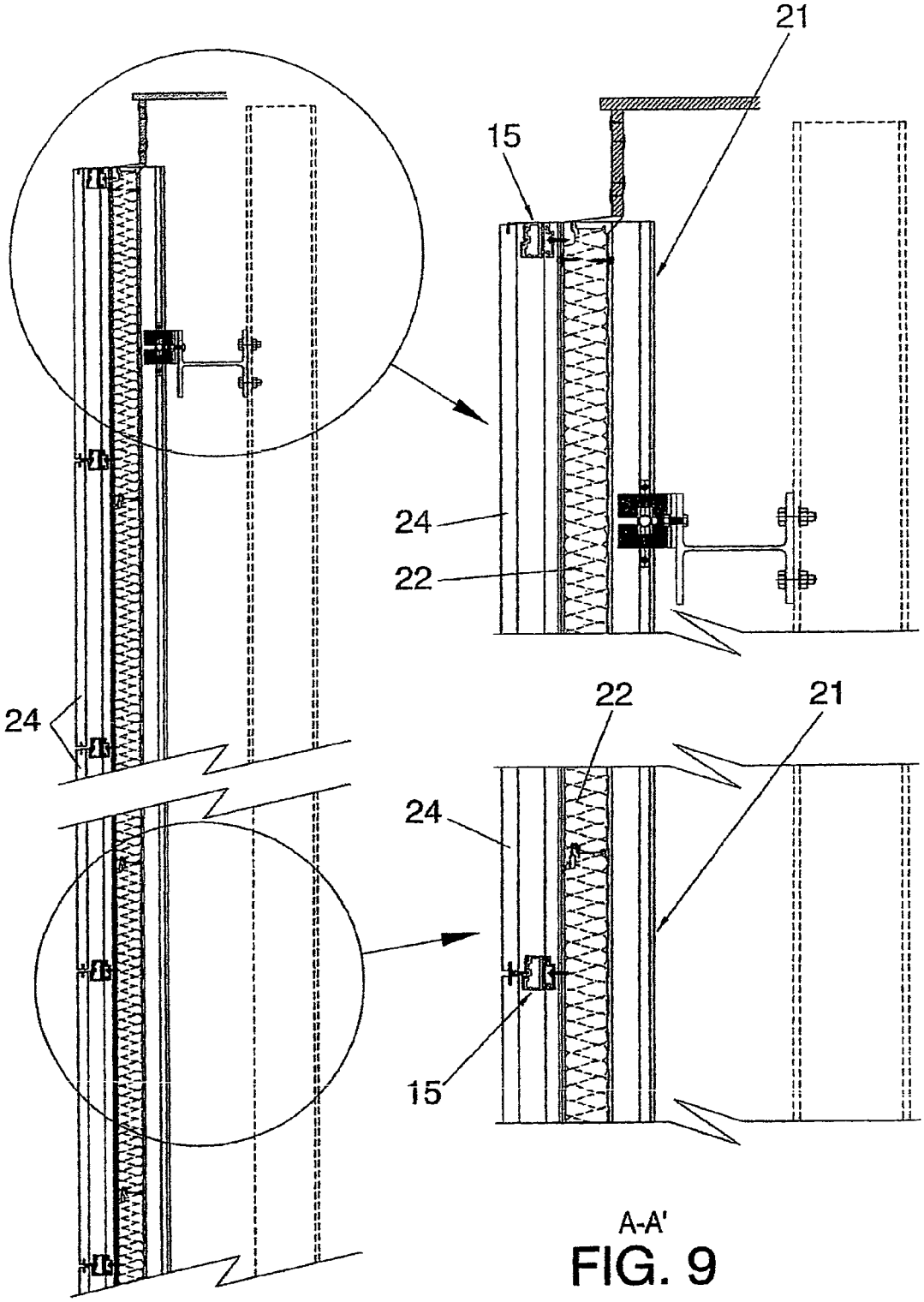
FIG. 9 shows a section by the cutting line A-A' of FIG. 1.
Figure 10:
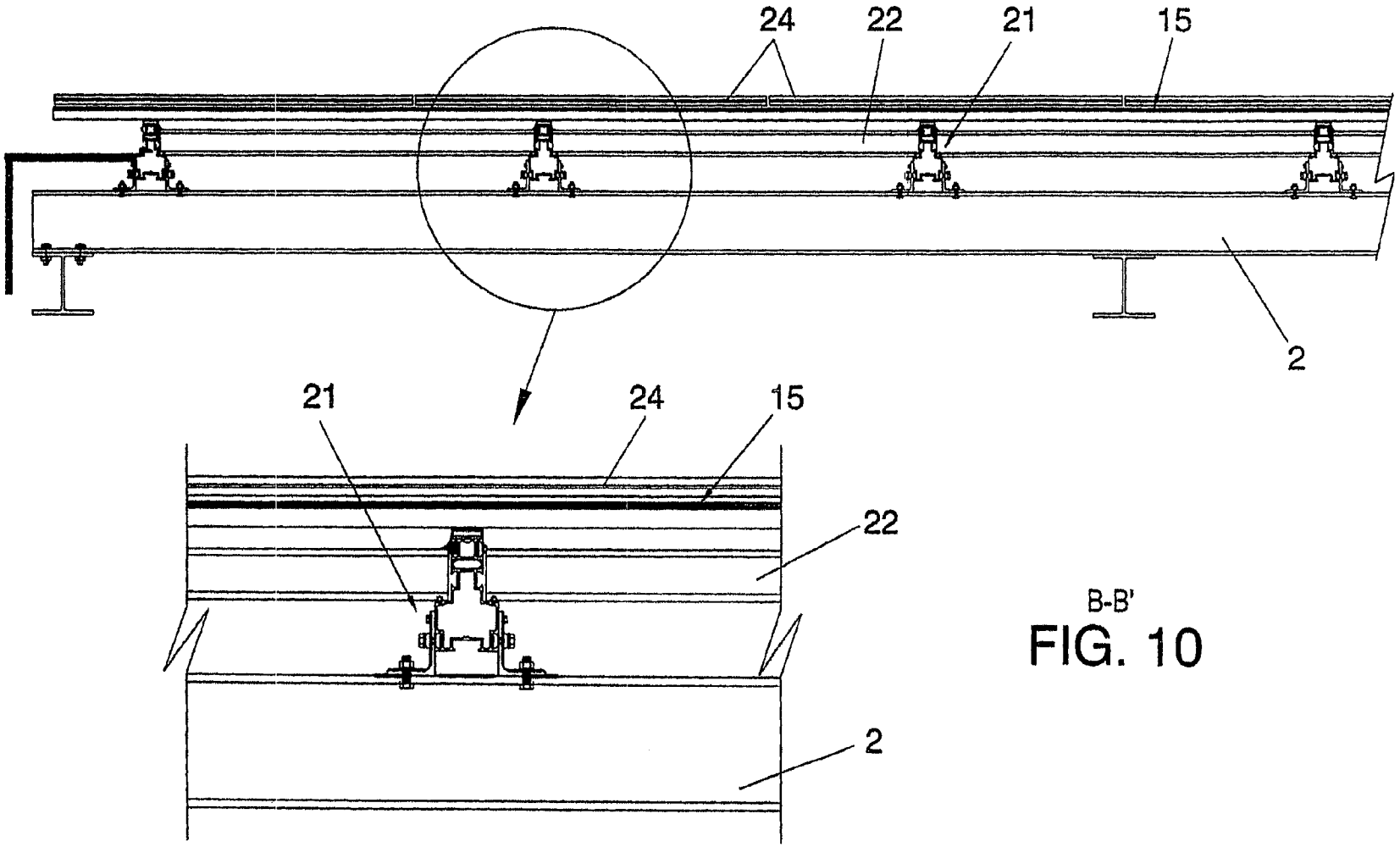
FIG. 10 shows a section by the cutting line B-B' of FIG. 1.
Figure 11:
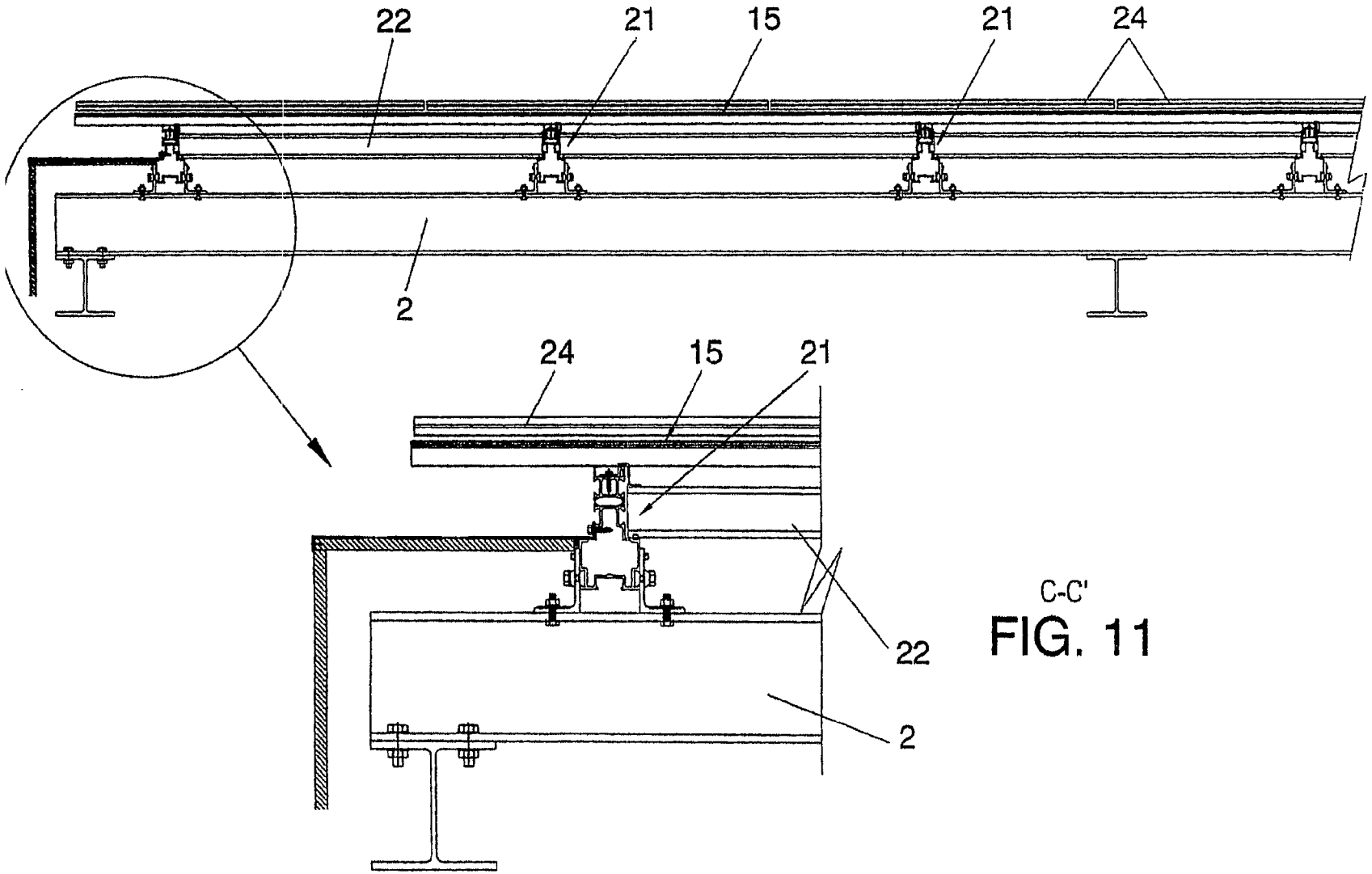
FIG. 11 shows a section by the cutting line B-C' of FIG. 1.

As for the horizontal profiles, they are referred to in general with the referential number 15, and are fixed to the vertical ones 1 through two parts 16 and 17, which connect one to the other. The first one 16 is inserted in the frontal rail 18, located in the vertical profile 1 to that end, and the second one 17 is inserted in the other rail 19 at the back of the horizontal profile 15 (see FIG. 8 as well).

Figure 4:
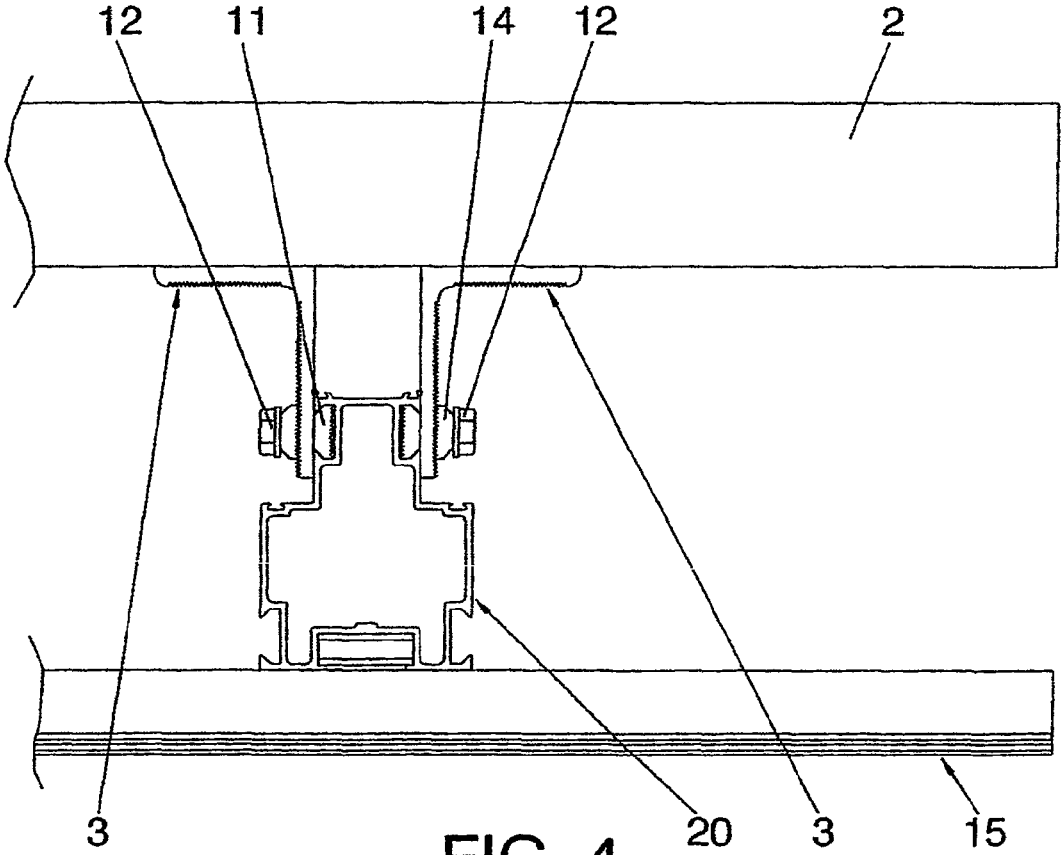
FIG. 4 shows a similar view to FIG. 3, with a vertical profile with a bigger section.

FIG. 4 shows the mounting of a resistant and bigger vertical profile 20, different from the one indicated as 1, which can be used according to the construction needs. If the brackets 3 can only be fixed from slab to slab, a profile indicated as 21, comprising the vertical profiles 1 and 20, is used, which includes a break of thermal bridge, as it can be clearly seen in any cross section in FIG. 5.

Figure 5:
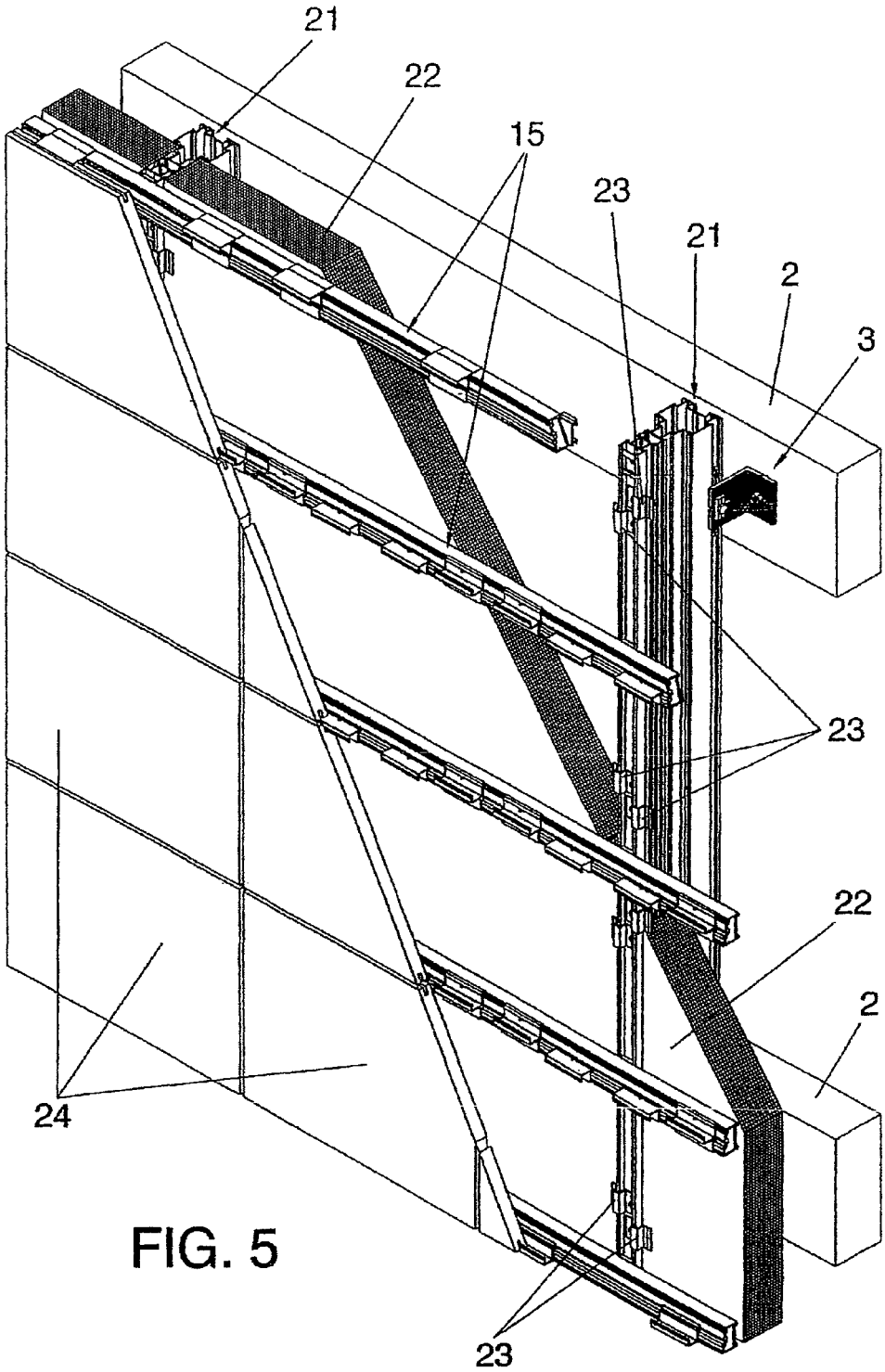
FIG. 5 shows a perspective partial view of a ventilated facade including the natural stone panels and vertical profiles with break of thermal bridge.

In this FIG. 5, once the vertical profiles 21 are plumbed, the insulating panels 22 are mounted through omega parts 23 which are fasten to the bottom of the rail 18 and cover its side without drilling it. The free wing holds the panel 22, which in turn serves as a cap on the shoulders of profile 21. Then, the horizontal profiles 15 are mounted and, finally, the flagstones or stone plates 24 are laid.

Figure 12:
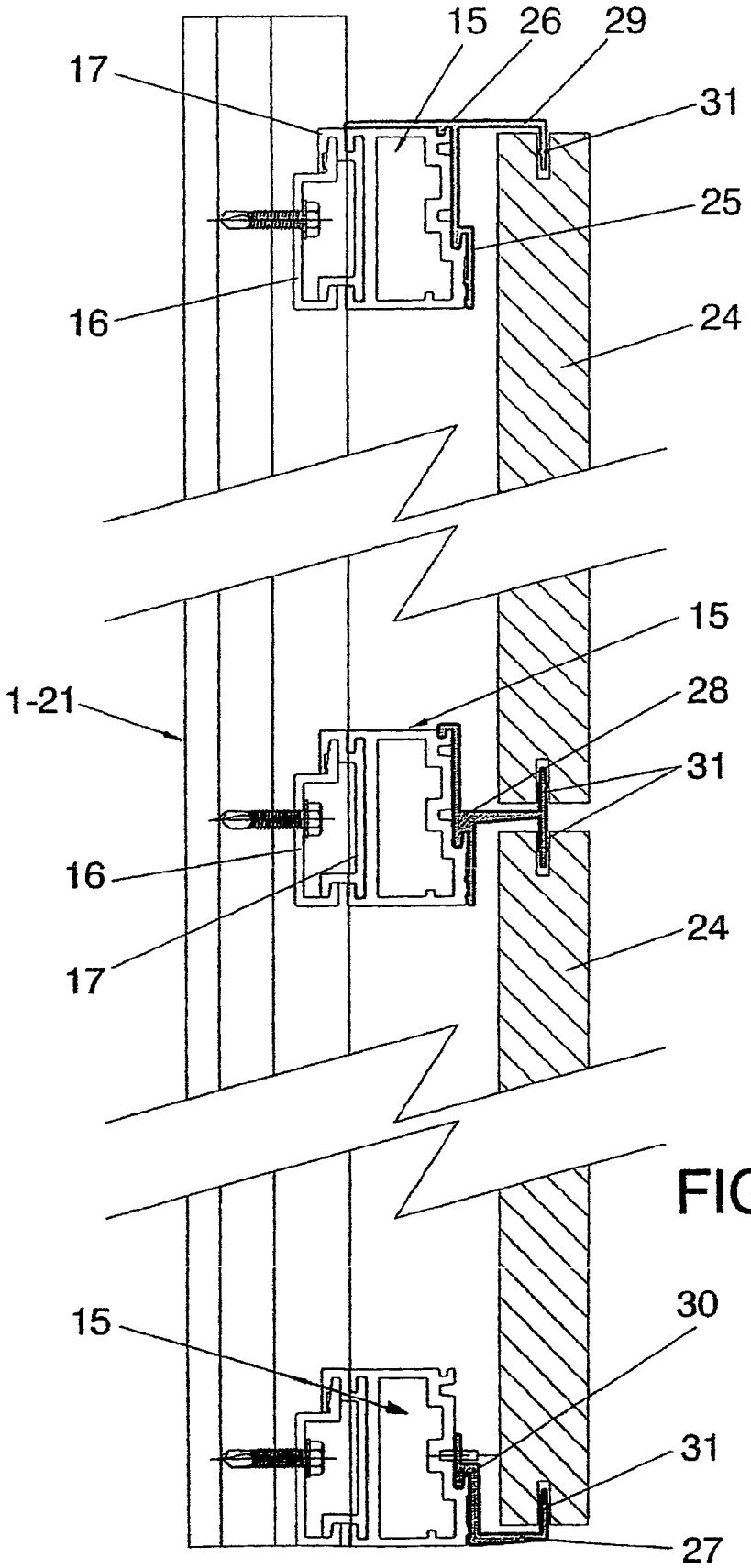
FIG. 12 shows an elevation partial sectional view, in a bigger scale, detailing the different kinds of anchoring clamps of the stone plate, according to the course being considered.

The natural stone plates 24 have a grooving on their entire longitudinal horizontal edges. As it can be seen in FIG. 12, these plates are mounted and fastened as follows. The horizontal profile 15 includes a pair of upward flanges 25 and 26 to couple the clips or retention clamps to the stone plates 24.

The clamps have different geometry according to whether they are initial clamps 27, intermediate clamps 28 or crowning clamps 29, being all of them independent parts anchored to the horizontal profile 15 by vertical sliding (safer than frontal insertion) and fastening the flagstone near the corners (at approximately one fourth of the length of the plates), thus, protecting these corners.

The initial or lower clamps 27 have a downward pin 30 on their back which is gripped in the upward pin 25 of the horizontal profile 15. Its orthogonal wing is bended upwards into an elbow defining an upward flange 31, which will be used to fit the first course of flagstones 24. Then, two intermediate clamps 28 per stone are placed on the next horizontal profile 15, acting these clamps 28 as retention clamps of the lower stone and, at the same time, as support clamps of the next flagstone, since they have two flanges 31, an upward flange and a downward flange.

The different rows or courses are thus placed, and at the end of the rows, the crowning clamps 29 are placed, which have a downward flange 31.

Figure 6:
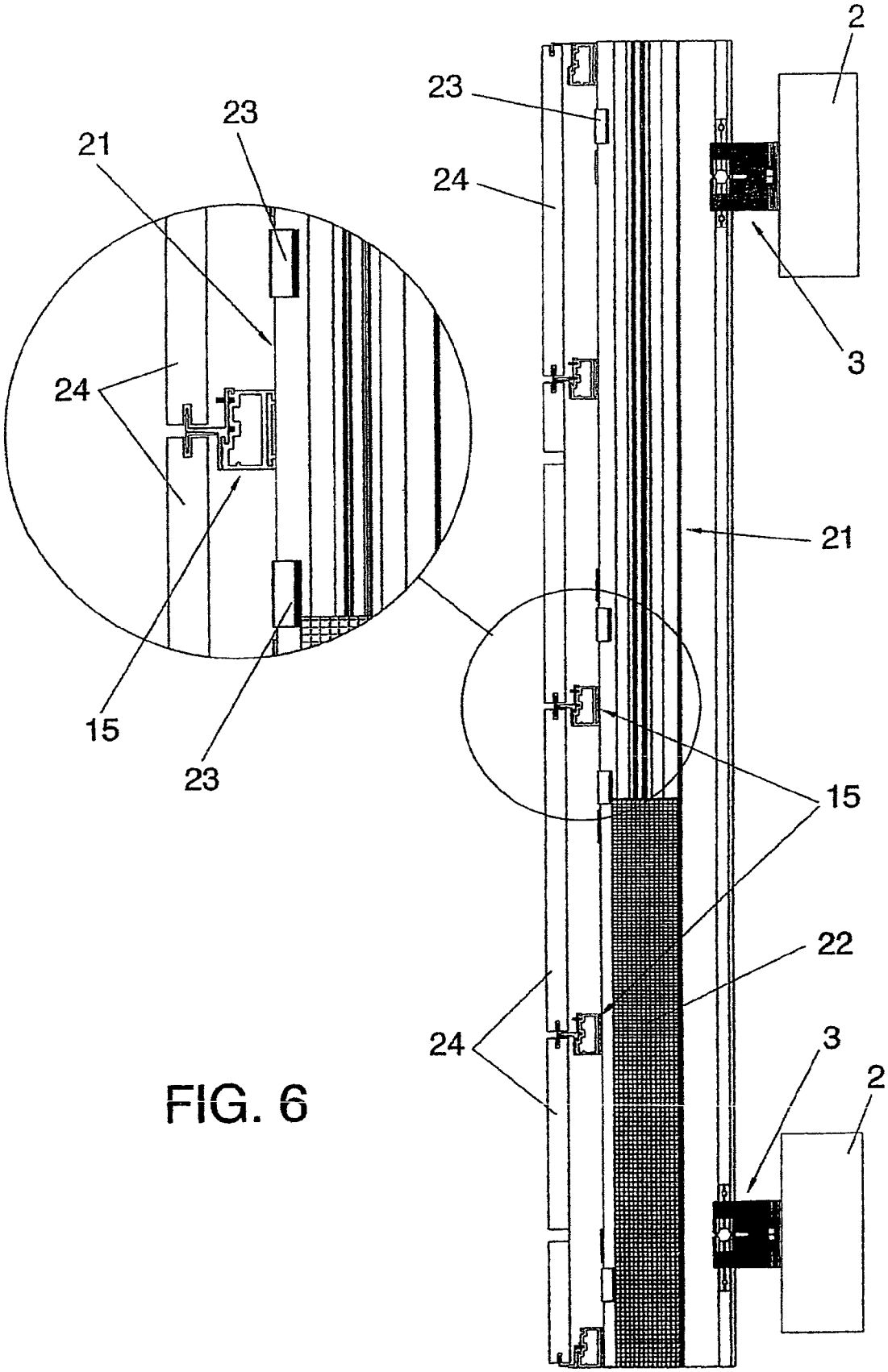
FIG. 6 shows an elevation lateral view of the illustration in FIG. 5.
Figure 7:
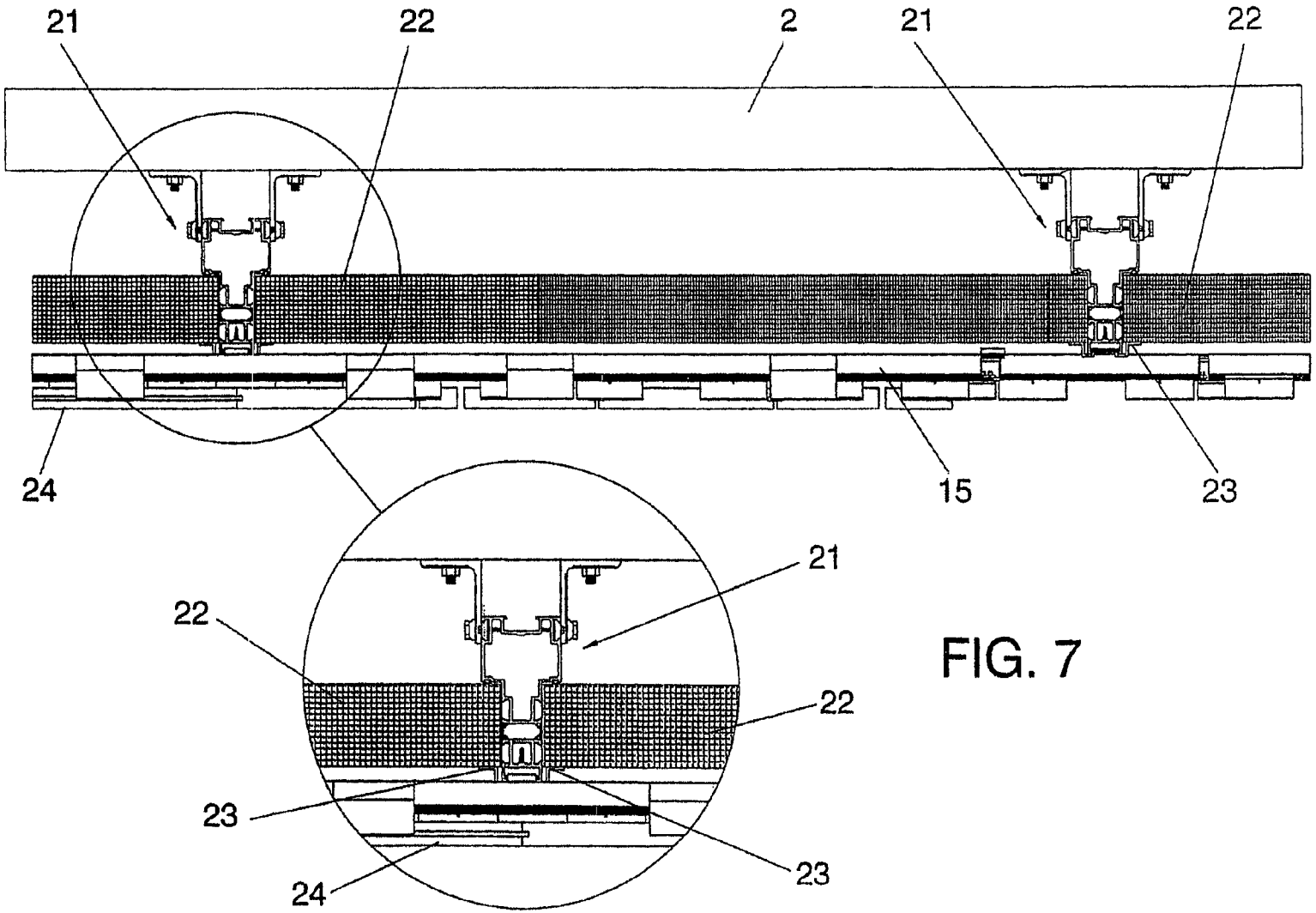
FIG. 7 shows a plan view of the illustration in FIG. 5.

Once they are placed in their position, each one of the clamps 27, 28 and 29 can be fixed to the horizontal profile 15 with elastic dowel pins (DIN1481, 7346 or 1473) for its correct fixing, as it can be seen in the enlarged detail in FIG. 6.

Figure 13A:
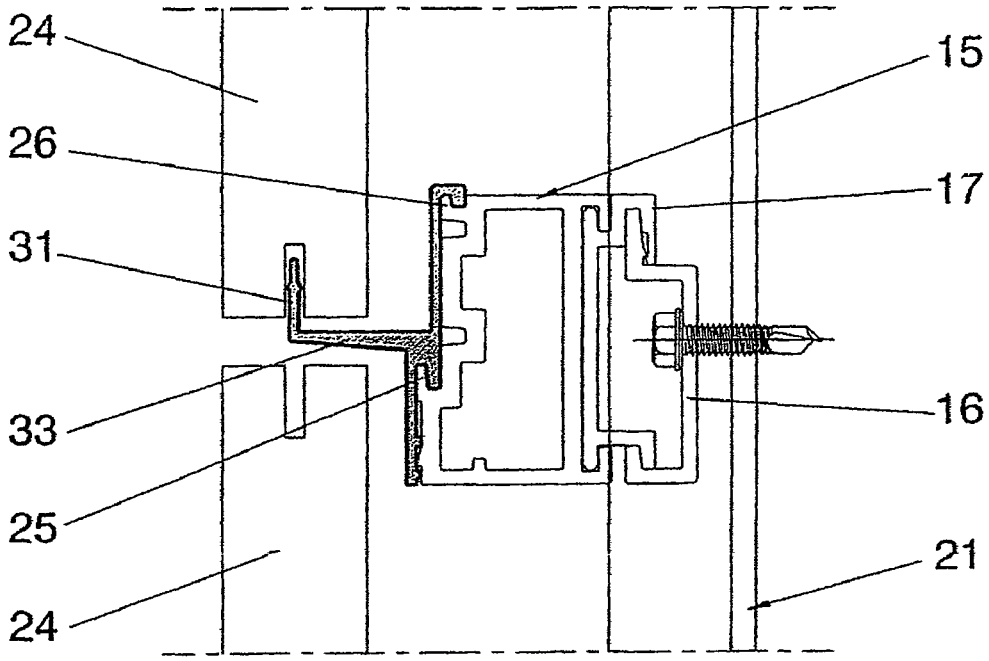
FIG. 13*a* shows a similar view to FIG. 12 but the clamp or clip shown fastens only the upper stone, allowing the replacement of the broken lower stone.
Figure 13B:
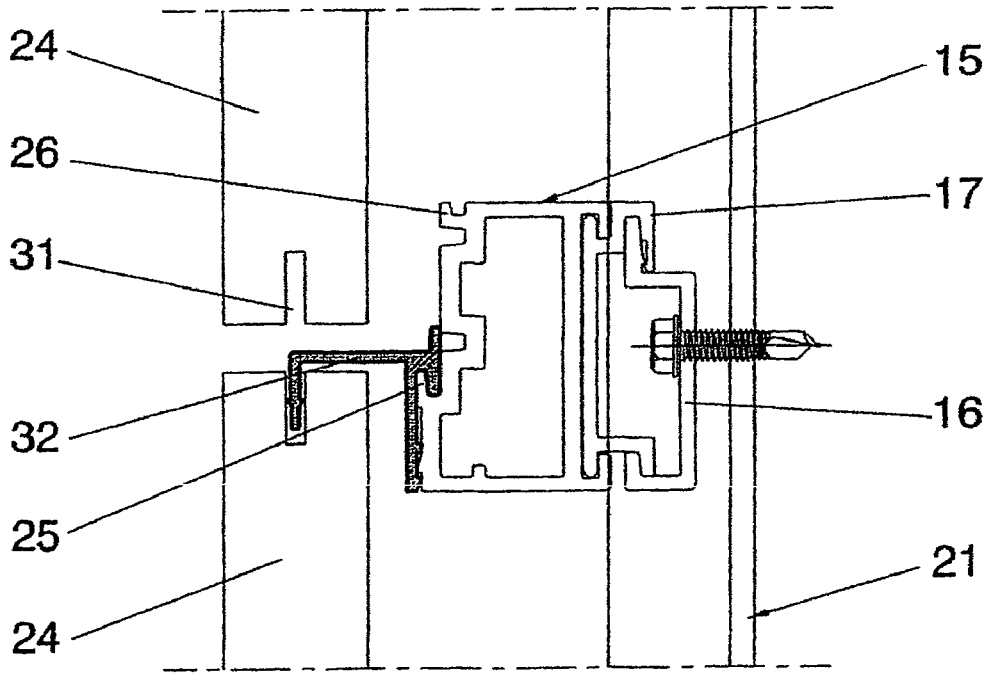
FIG. 13*b* shows a similar view to FIG. 13*a* but the clip shown fastens the replaced stone in the upper part; the clip that fastens the upper stone is not shown for a better understanding of the figure.
Figure 14A:
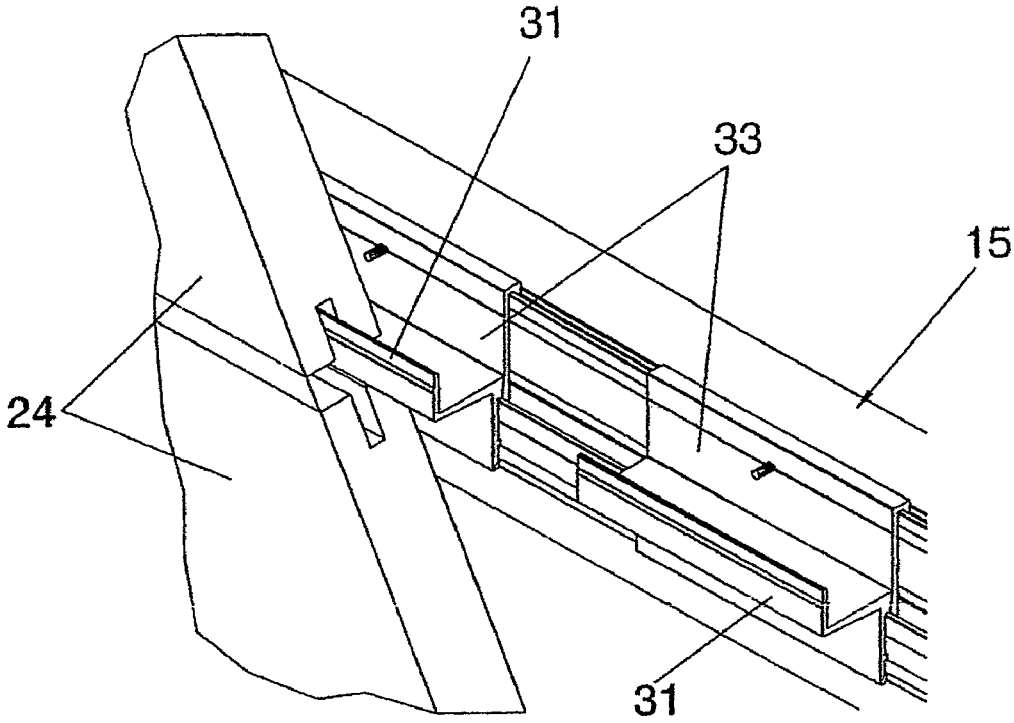
FIG. 14*a* shows a perspective view of the illustration in FIG. 13*a*.
Figure 14B:
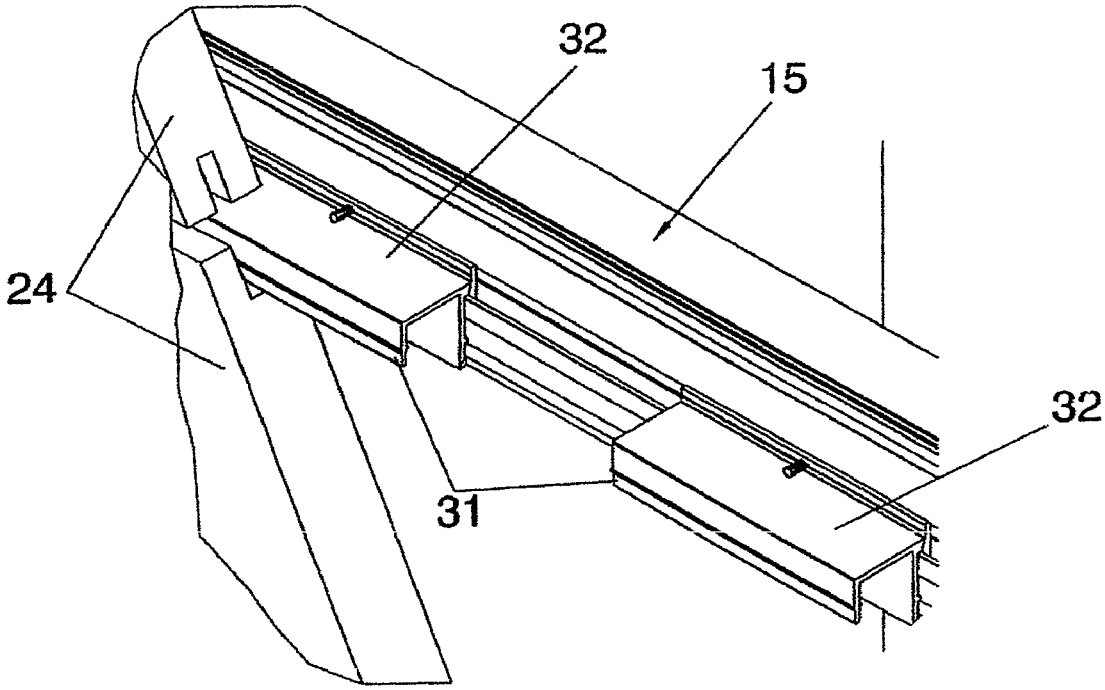
FIG. 14*b* shows a perspective view of the illustration in FIG. 13*b*.

Referring now specially to FIGS. 13*a* and 13*b*, which show respective elevation sections, and FIGS. 14*a* and 14*b*, which show a perspective view of the illustrations in FIGS. 13*a* and 13*b*, they illustrate the shapes of two other types of clamps 32 and 33, which are used for replacing one of the flagstones if it breaks or for any other reason. In order to replace such flagstone, the intermediate clamp 28 of the lower side of the broken stone is broken using a radial saw, inserting the cutting disc between the two stones 24 and extracting the broken stone 24. Then, the clamps 32 are fixed in order to hold the preceding flagstone and the support clamps 33, thus, keeping the stone perfectly fastened.

The vertical profile 20 of the compound mast 21 also has grooves for inserting gaskets when the sandwich-paned insulating panels 22 are laid.

Since the horizontal profiles 15 do not have an upper continuous wing for the direct mounting of the flagstones 24, since they are mounted using independent clamps, the system can be adapted to any facade element (wood, metal panels, alucobond panels, ceramic, terracotta, etc.), simply by changing the clips or clamps for others with the adequate shape.

The invention claimed is:

1. An anchorage system of ventilated facades comprising:
vertical profiles anchored to a structure via brackets, and
horizontal profiles fastened to the vertical profiles via two unitary complementary anchoring parts, wherein the complementary anchoring parts being separate from the horizontal profile and the vertical profile when the anchorage system is not fastened together, and
retention elements fastened to the horizontal profiles for securing the facades,
wherein each of the vertical profiles includes a C-rail, into which slides a first of the complementary anchoring parts,
wherein each of the horizontal profiles include a C-rail, into which slides a second of the complementary anchoring parts,
wherein the second of the complementary anchoring parts is gripped on the first of the complementary anchoring parts at crosspoints of the vertical profiles and the horizontal profiles by vertical sliding.

2. The anchorage system of ventilated facades, according to claim 1, wherein each of the horizontal profiles further includes an upper flange and a paracentral flange for coupling the retention elements, and wherein each of the retention elements includes at least one downward pin for engaging at least one of the flanges on the horizontal profile, and wherein each of the retention elements further includes an orthogonal wing defining at least one flange for engaging and securing the facades.

3. The anchorage system of ventilated facades, according to claim 1, wherein each of the vertical profiles includes side rails which receive sliding bars, wherein each of the sliding bars includes a central threaded hole for fixing bolts which go through the brackets and through serrated lockwashers connecting with a cogged surface of the brackets, and two end holes for bearing a dead load with two self-tapping screws that go through the end holes of the sliding bars.

4. The anchorage system of ventilated facades, according to claim 3, wherein the sliding bars include a cogged surface analogous to that of the cogged surface of the brackets.

5. The anchorage system of ventilated facades, according to claim 3, wherein each of the vertical profiles comprises an outer vertical profile attached to an inner vertical profile via parallel ties resulting in a break of thermal bridge between the outer vertical profile and the inner vertical profile, and forming a compound vertical profile, and wherein the inner vertical profile includes side rails for mounting the sliding bars to the brackets, and wherein the inner vertical profile is wider than the outer vertical profile so as to define a setting for insulating panels, wherein the insulated panels are held in place by Omega-shaped clips fixed to the outer vertical profile.

6. The anchorage system of ventilated facades, according to claim 5, wherein the inner vertical profile includes a grooving to locate gaskets for mounting sandwich-paned panels.

7. The anchorage system of ventilated facades, according to claim 2, further comprising replacement clamps which have at least one downward pin for engaging at least one of the flanges on the horizontal profile and comprising an orthogonal wing having a single flange for engaging and securing the facades.

8. A system for anchoring panels to a structure, comprising:
at least one vertical profile fixed to the structure;
at least one first connector slidably engaging the vertical profile and secured thereto;
at least one horizontal profile;
at least one second connector slidably engaging the horizontal profile, wherein the at least one first connector and the at least one second connector are unitary and separate from the horizontal profile and the vertical profile when the system is not fastened together;
wherein the vertical profile and the horizontal profile intersect at crosspoints, and wherein the at least one second connector connects to the at least one first connector at the crosspoints by vertical sliding.

9. The system of claim 8, further comprising at least one retention clamp engaging the horizontal profile, the retention clamp defining a flange for anchoring the panels.

10. The system of claim 9, wherein the retention clamp has an orthogonal wing with the flange extending upward for engaging a lower edge of a panel.

11. The system of claim 9, wherein the retention clamp has an orthogonal wing with the flange extending downward for engaging an upper edge of a panel.

12. The system of claim 9, wherein the retention clamp has an orthogonal wing with the flange extending both upward and downward for engaging a lower edge and an upper edge of a adjacent panels.

13. The system of claim 9, wherein the horizontal profile has at least one upward flange, and wherein the retention clamp has at least one downward pin for engaging the upward flange of the horizontal profile for affixing the retention clamp to the horizontal profile.

14. The system of claim 8, wherein the vertical profile includes side rails, the system further comprising at least one sliding bar received in the side rails for attaching brackets to the vertical profile for securing the vertical profile to the structure.

15. The system of claim 8, wherein the vertical profile comprises a combined vertical profile having an inner vertical profile and an outer vertical profile attached via parallel ties and defining a break of thermal bridge between the outer vertical profile and the inner vertical profile.

16. The system of claim 15, wherein the inner vertical profile is wider than the outer vertical profile to define a setting for insulated panels.

17. The system of claim 16, further comprising Omega-shaped clips attached to the outer vertical profile for securing the insulated panels.

* * * * *